US011358299B2

(12) United States Patent
Huang et al.

(10) Patent No.: US 11,358,299 B2
(45) Date of Patent: Jun. 14, 2022

(54) TABLE SAW WITH A RIP FENCE LOCKING DEVICE

(71) Applicant: P & F BROTHER INDUSTRIAL CORPORATION, Taichung (TW)

(72) Inventors: Chih-Yung Huang, Taichung (TW); Po-Hsun Lin, Taichung (TW)

(73) Assignee: P&F BROTHER INDUSTRIAL CORPORATION, Taichung (TW)

( * ) Notice: Subject to any disclaimer, the term of this patent is extended or adjusted under 35 U.S.C. 154(b) by 49 days.

(21) Appl. No.: 17/099,923

(22) Filed: Nov. 17, 2020

(65) Prior Publication Data

US 2022/0040879 A1 Feb. 10, 2022

(30) Foreign Application Priority Data

Aug. 5, 2020 (TW) ..... 109126561

(51) Int. Cl.
*B27B 27/02* (2006.01)

(52) U.S. Cl.
CPC ..... *B27B 27/02* (2013.01)

(58) Field of Classification Search
CPC ..... B27B 27/00; B27B 27/02; B27B 27/04; B27B 27/06; B27B 27/08; B27B 27/10; Y10T 83/727; Y10T 83/7647; B23D 47/025
USPC ..... 83/438–450
See application file for complete search history.

(56) References Cited

U.S. PATENT DOCUMENTS 5,115,847 A * 5/1992 Taber ..... B23D 47/025 108/69
5,722,308 A * 3/1998 Ceroll ..... B23Q 3/007 144/253.1
5,845,555 A * 12/1998 Dawley ..... B23Q 16/006 83/467.1
6,986,370 B1 * 1/2006 Schoene ..... B23D 45/062 108/102
7,156,008 B2 * 1/2007 Talesky ..... B23D 47/04 83/468.2
8,424,434 B2 * 4/2013 Koegel ..... B27B 5/243 83/477.2
2007/0245869 A1 * 10/2007 Welsh ..... B23D 45/068 83/438
2011/0017040 A1 * 1/2011 Folov ..... B26D 7/01 83/477.2
2011/0048201 A1 * 3/2011 Frolov ..... B27B 27/02 83/477.2
2011/0061508 A1 * 3/2011 Scherl ..... B27B 27/02 83/438
2015/0107429 A1 * 4/2015 Ceroll ..... B23D 47/025 83/468.7

(Continued)

*Primary Examiner* — Jason Daniel Prone
*Assistant Examiner* — Richard D Crosby, Jr.
(74) *Attorney, Agent, or Firm* — Rosenberg, Klein & Lee

(57) ABSTRACT

A table saw includes a locking device disposed on a rip fence device to couple a moving unit of the rip fence device to a rail unit of a worktable device. The locking device includes a locking pin extending and movable along an axis relative to the moving unit, and a turning member turnable about the axis to move the locking pin along the axis so as to lock or unlock the moving unit to or from the rail unit. An extending direction of the axis is parallel to the upper surface so as to render the turning operation of the turning member quick and convenient.

9 Claims, 10 Drawing Sheets

(56) References Cited

U.S. PATENT DOCUMENTS

2015/0183123 A1* 7/2015 Niichel ..... B23D 59/00
83/418
2016/0121412 A1* 5/2016 Fulmer ..... B23D 47/025
83/477.2

* cited by examiner

TABLE SAW WITH A RIP FENCE LOCKING DEVICE

CROSS-REFERENCE TO RELATED APPLICATION

This application claims priority of Taiwanese Patent Application No. 109126561, filed on Aug. 5, 2020.

FIELD

The disclosure relates to a table saw, and more particularly to a table saw with a locking device for quickly locking a rip fence to a worktable.

BACKGROUND

Referring to FIGS. 1, 2 and 3, a conventional table saw includes a worktable device 11, a saw blade device 12, a rip fence device 13 and a locking plate 14. The worktable device 11 has a rail 111 slidably engaged to a side of a worktable, and having an elongated slot 112. The saw blade device 12 extends through the worktable device 11 for cutting a workpiece placed on an upper surface of the worktable. The rip fence device 13 is removably disposed on the worktable device 11, and includes a rip fence 131 spanning between front and rear edges of the upper surface of the worktable to be put on a side of the workpiece, and a slide seat 132 connected with the rip fence 131 and movable with the rail 111. The locking plate 14 is pivotably connected to the slide seat 132 and has an operating portion 141 and a retained engaging portion 142 diametrically opposite to each other in terms of an upright axle 140 such that, by turning the operating portion 141, the retained engaging portion 142 is retainingly engaged in the elongated slot 112 to lock the rip fence device 13 to the rail 111. However, due to the upright axle 140, turning of the operating portion 141 is limited and inconvenient to conduct.

SUMMARY

Therefore, an object of the disclosure is to provide a table saw that can alleviate at least one of the drawbacks of the prior art.

According to the disclosure, the table saw is adapted for cutting a workpiece which has an abutting side, and includes a worktable device, a saw blade device, a rip fence device and at least one locking device. The worktable device includes a worktable and a rail unit disposed on the worktable and extending in a left-right direction. The worktable has an upper surface for placing the workpiece. The upper surface has an opening therethrough. The saw blade device is mounted on the worktable device and includes a blade extending through the opening of the upper surface. The rip fence device includes a moving unit removably disposed on the rail unit, and a rip fence attached to the moving unit and extending in a front-rear direction perpendicular to the left-right direction. The rip fence has an abutted surface for the abutting side of the workpiece to abut thereagainst. The locking device is disposed on the rip fence device to couple the moving unit to the rail unit. The locking device includes a locking pin which extends and is movable along an axis relative to the moving unit, and a turning member which is turnable relative to the moving unit about the axis such that turning of the turning member about the axis results in movement of the locking pin along the axis relative to the worktable between an engaging position, where the locking pin engages in the rail unit to lock the moving unit to the rail unit, and a disengaging position, where the locking pin is disengaged from the rail unit to permit displacement of the moving unit relative to the worktable device. An extending direction of the axis is parallel to the upper surface such that the turning operation of the turning member is quick and convenient to conduct.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
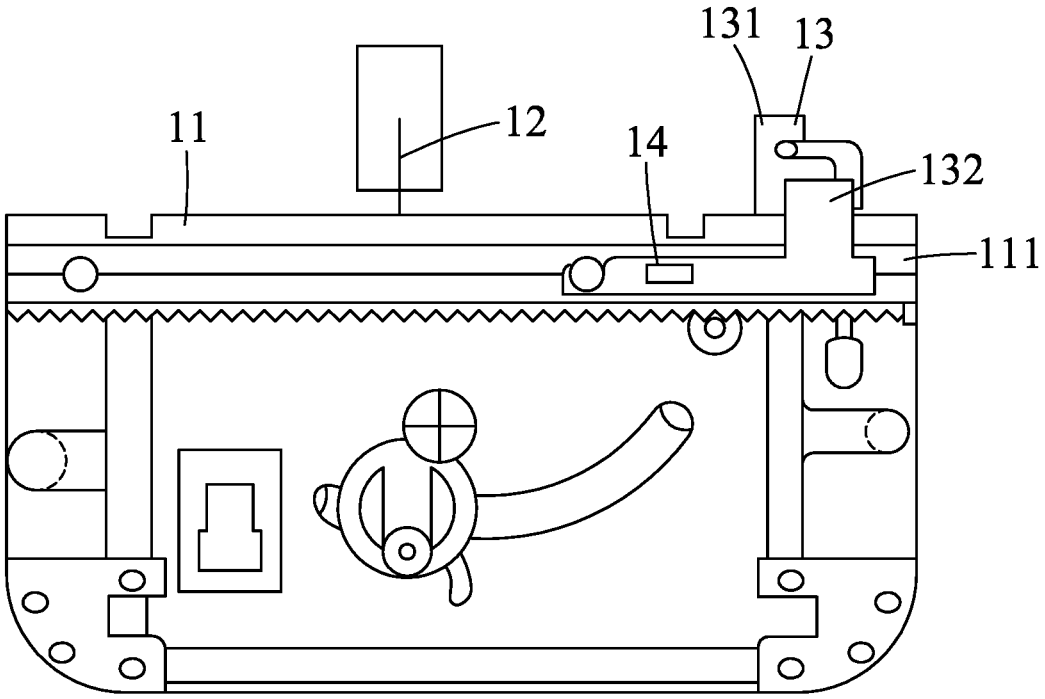
FIG.1 PRIOR ART
FIG. 1 is a schematic front view of a conventional table saw.
Figure 2:
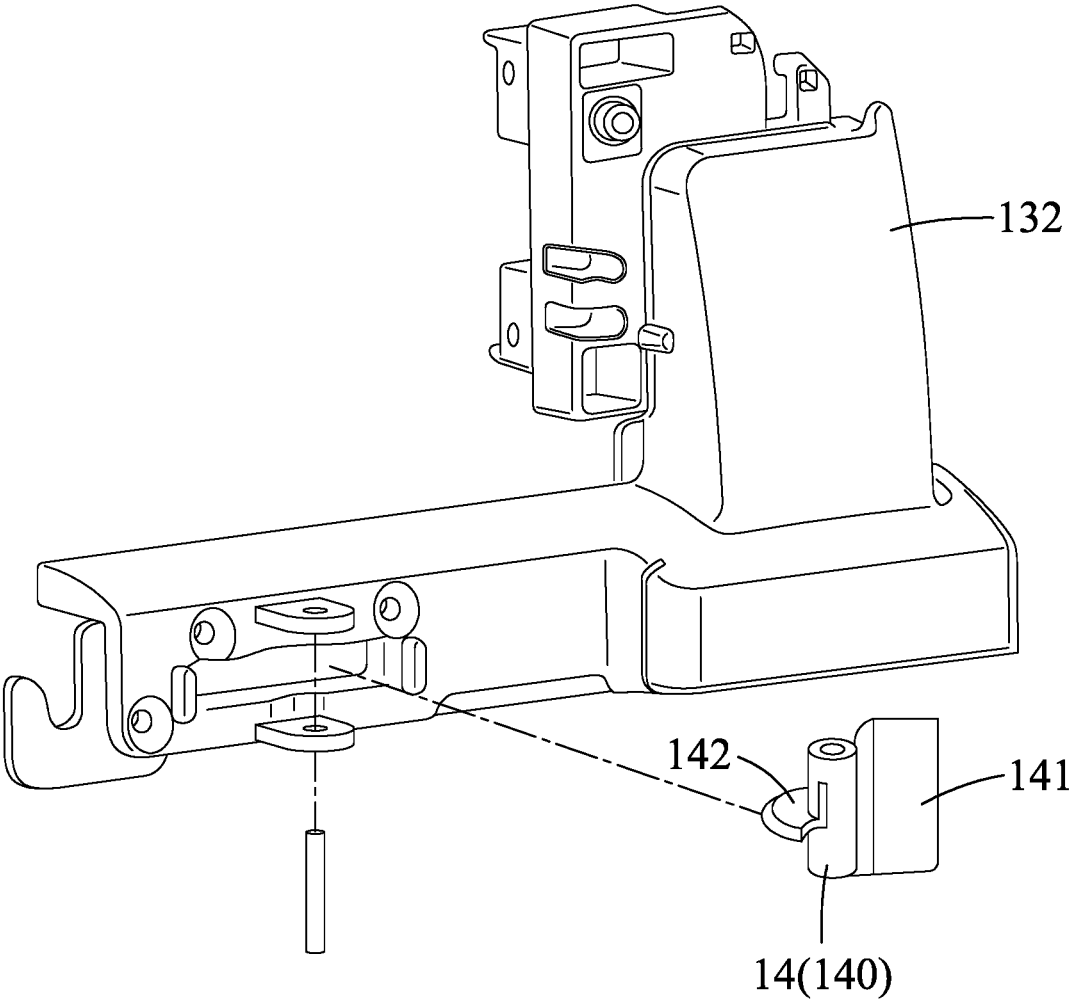
FIG.2 PRIOR ART
FIG. 2 is an exploded perspective view of a slide seat and a locking plate of the conventional table saw.
Figure 3:
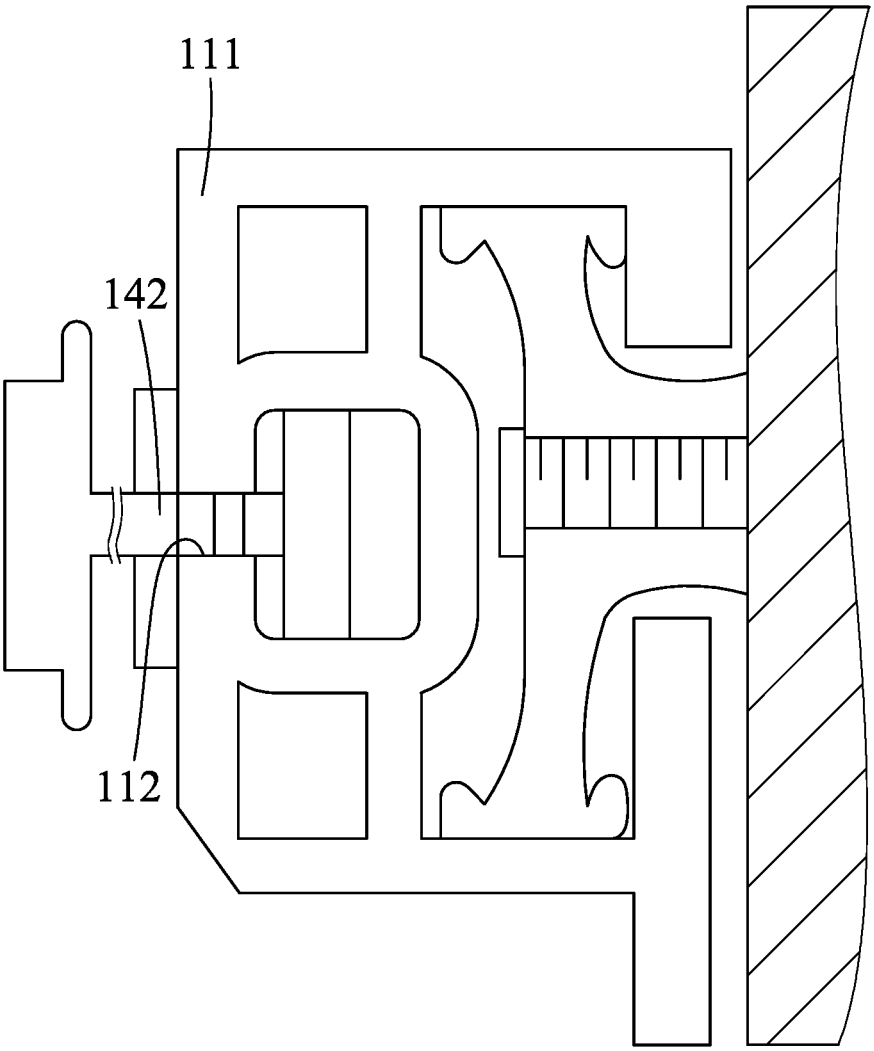
FIG.3 PRIOR ART
FIG. 3 is a fragmentary, partly sectional view of the conventional table saw, illustrating a retained engaging portion of the locking plate engaged in an elongated slot.
Figure 4:
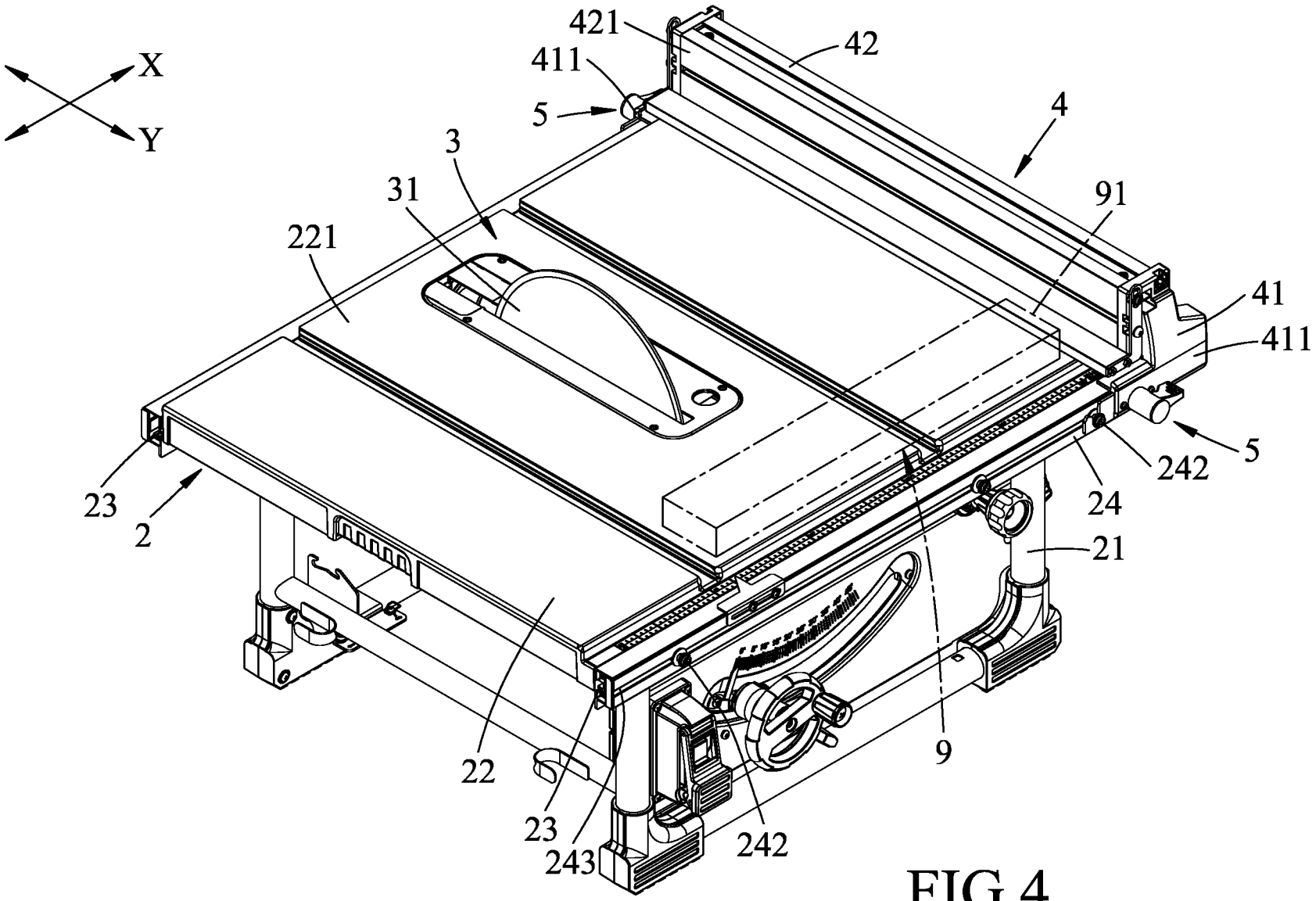
FIG. 4 is a perspective view illustrating an embodiment of a table saw according to the disclosure.
Figure 5:
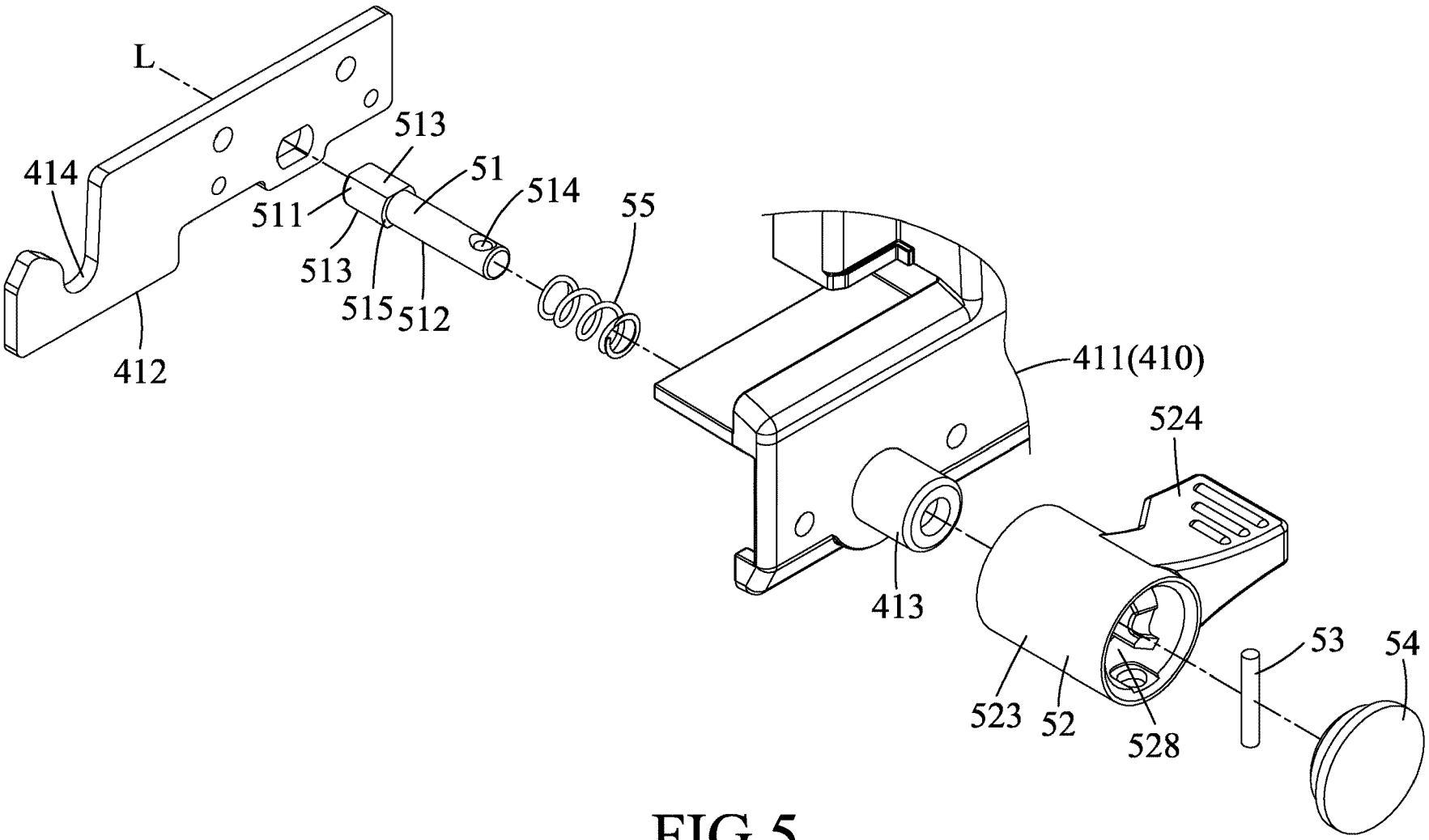
FIG. 5 is a fragmentary, exploded perspective view of the embodiment.
Figure 6:
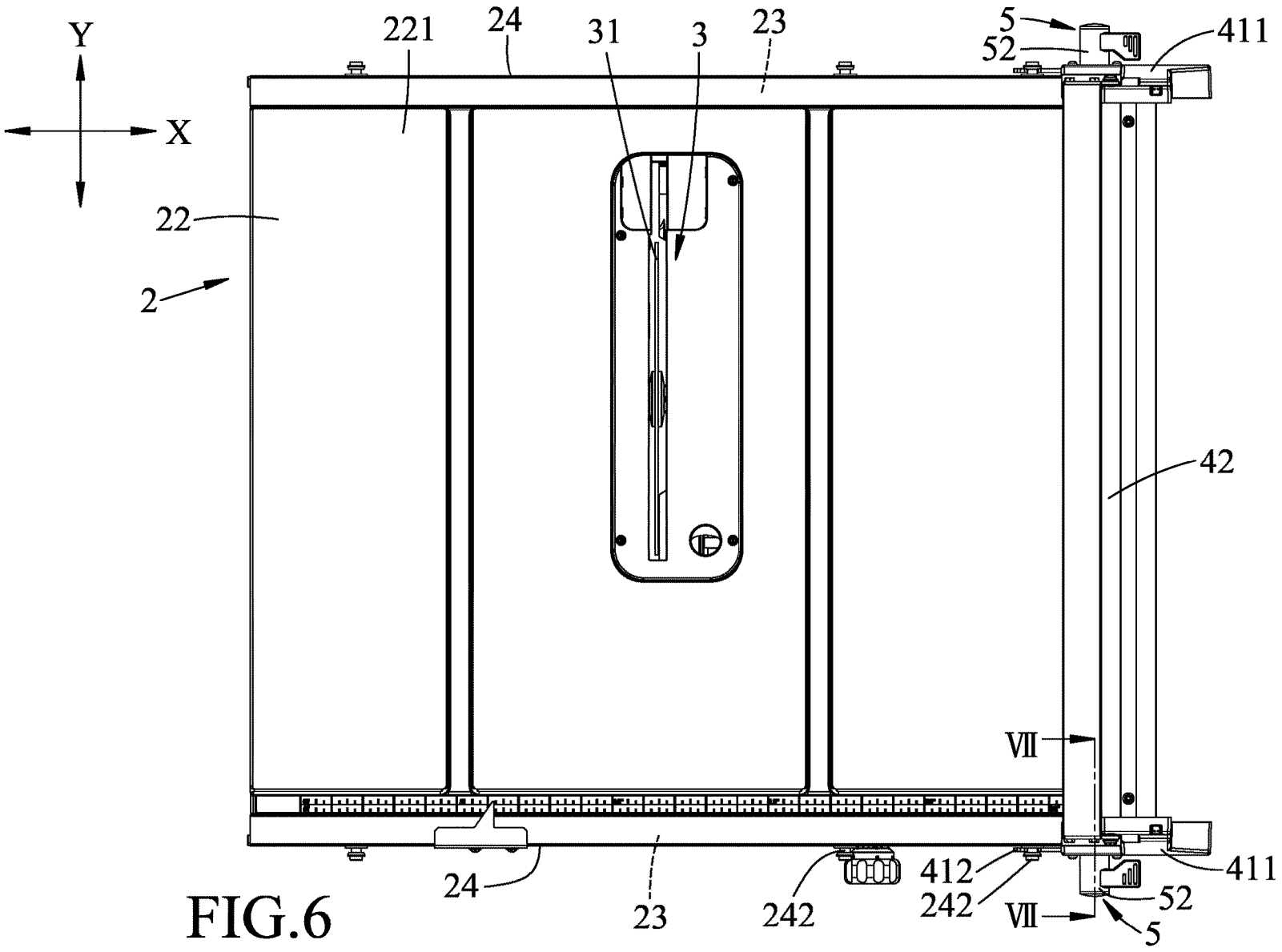
FIG. 6 is a top view of the embodiment.

Referring to FIGS. 4 to 6, an embodiment of a table saw according to the disclosure is adapted for cutting a workpiece 9 which has an abutting side 91. The table saw includes a worktable device 2, a saw blade device 3, a rip fence device 4 and two locking devices 5.

Figure 7:
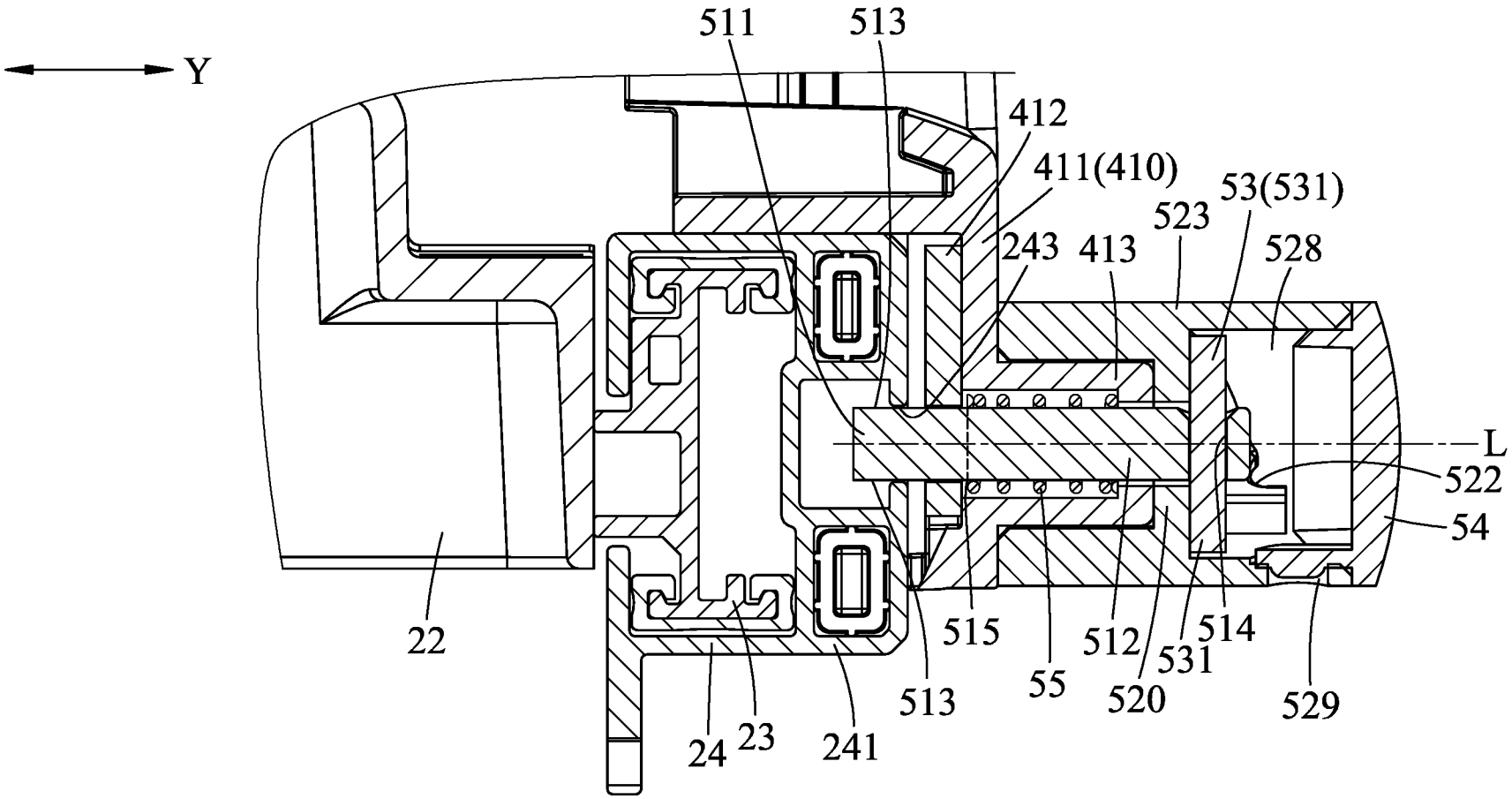
FIG. 7 is a sectional view taken along line VII-VII of FIG. 6, illustrating a state when a locking pin is in an engaging position.

With reference to FIGS. 4, 6 and 7, the worktable device 2 includes a base frame 21, a worktable 22 mounted on the base frame 21, two guideways 23 disposed on front and rear sides of the worktable 22, respectively, and each extending in a left-right direction (X), and a rail unit 24 disposed on the worktable 22 and movable and extending in the left-right direction (X). The worktable 22 has an upper surface 221 for placing the workpiece 9. The upper surface 221 has an opening therethrough. The rail unit 24 has two slide rails 241 which are slidably engaged with the guideways 23 in the left-right direction (X), respectively, and a plurality of retaining members 242 which are disposed on the slide rails 241. Each slide rail 241 has an elongated slot 243 which extends in the left-right direction (X). The retaining members 242 are securely disposed in the elongated slot 243. In this embodiment, the retaining members 242 are screw fasteners.

The saw blade device 3 is mounted on the worktable device 2, and includes a blade 31 extending through the opening of the upper surface 221 to be used to cut the workpiece 9.

Referring to FIGS. 4, 5 and 7, the rip fence device 4 includes a moving unit 41 removably disposed on the rail unit 24, and a rip fence 42 attached to the moving unit and extending in a front-rear direction (Y) perpendicular to the left-right direction (X). The rip fence 42 has an abutted surface 421 for the abutting side 91 of the workpiece 9 to abut thereagainst. The moving unit 41 has two slide seats 411 attached to front and rear ends of the rip fence 42, respectively. Each slide seat 411 has an L-shaped wall 410 which is in abutting engagement with the corresponding rail 241, and a tubular wall 413 which extends from the L-shaped wall 410 in the front-rear direction and which surrounds an axis (L). The moving unit 41 further has two reinforcement plates 412 each disposed between the worktable 22 and the corresponding slide seat 411. Each reinforcement plate 412 has a notch 414 for engagement with a selected one of the retaining members 242 in an upright direction that is transverse to both the left-right direction (X) and the front-rear direction (Y). In various other embodiments, one or three of the slide seat(s) 411 may be provided. In this embodiment, the reinforcement plates 412 are made of metal material or any other material with a high strength so as to reinforce the structural strength of the moving unit 41.

The locking devices 5 are disposed on the rip fence device 4 to couple the moving unit 41 to the rail unit 24. Each locking device 5 includes a locking pin 51, a turning member 52, a driven crosspiece 53, an end cap 54 and a biasing member 55. The locking pin 51 extends and is movable along the axis (L) relative to the moving unit 41. The turning member 52 is turnable relative to the moving unit 41 about the axis (L). The driven crosspiece is connected with the locking pin 51 and extends transverse to the axis (L) to have two ends 531. The end cap 54 is removably disposed on the turning member 52. The biasing member 55 is disposed between the locking pin 51 and the slide seat 411.

Specifically, the locking devices 5 are disposed on the slide seats 411, respectively. Each locking pin 51 has a retained end portion 511 which is in abutting engagement with the elongated slot 243, and a driven end portion 512 which is opposite to the retained end portion 511 along the axis (L) and which projects outwardly of the tubular wall 413. In this embodiment, the retained end portion 511 has two flat abutting surfaces 513 opposite to each other in the upright direction, and has a cross-section larger than that of the driven end portion 512 to form a shoulder 515 therebetween. The driven end portion 512 has a penetrating bore 514 extending therethrough in the upright direction for the driven crosspiece 53 to extend through the penetrating bore 514. The biasing member 55 is a compression spring sleeved around the locking pin 51, and abuts against the shoulder 515 and a rear side of the tubular wall 413. Alternatively, the biasing member 55 may be a coil spring disposed between the turning member 52 and the slide seat 411.

Figure 8:
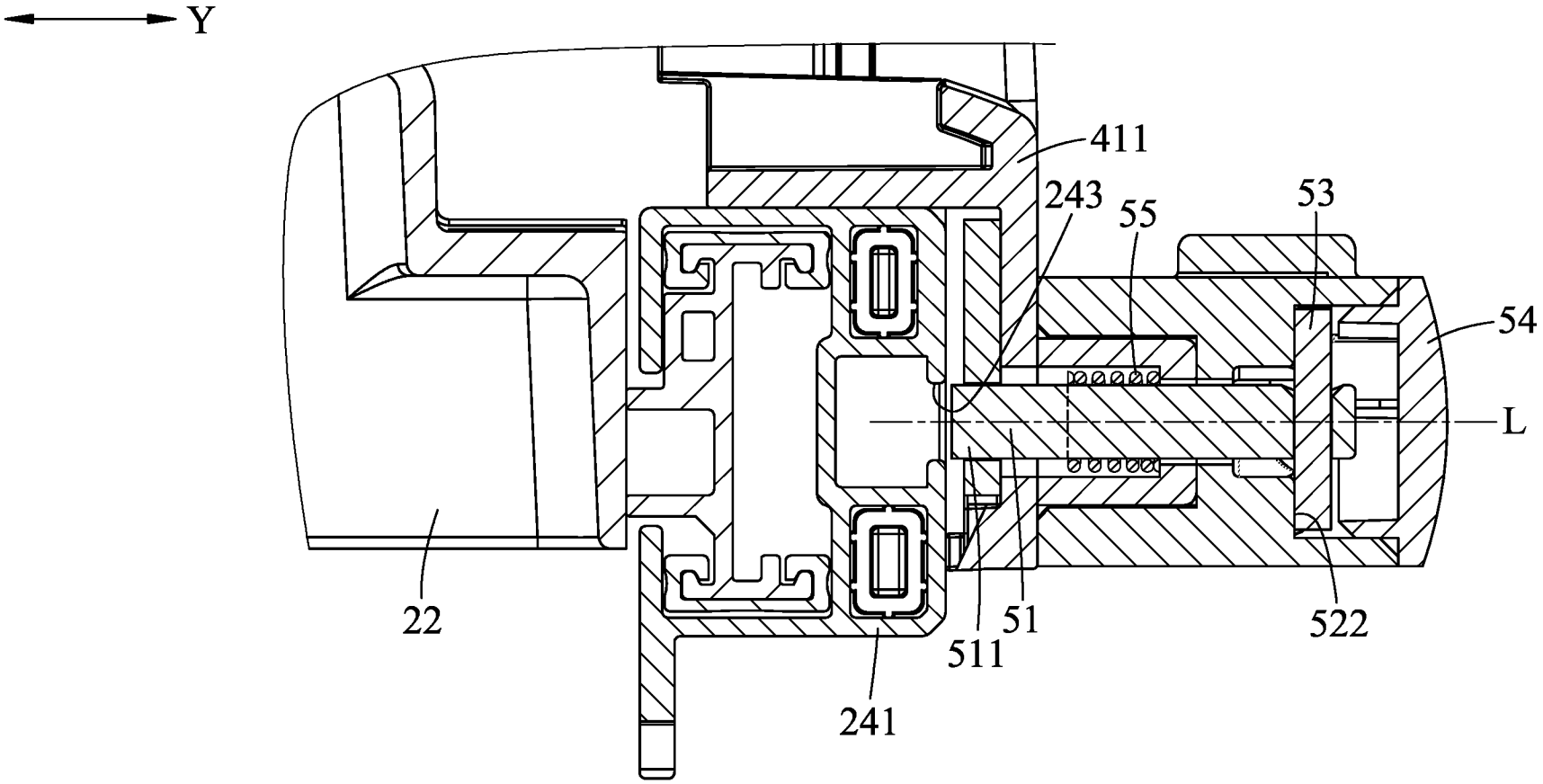
FIG. 8 is a sectional view similar to FIG. 7, illustrating a state when the locking pin is in a disengaging position.
Figure 9:
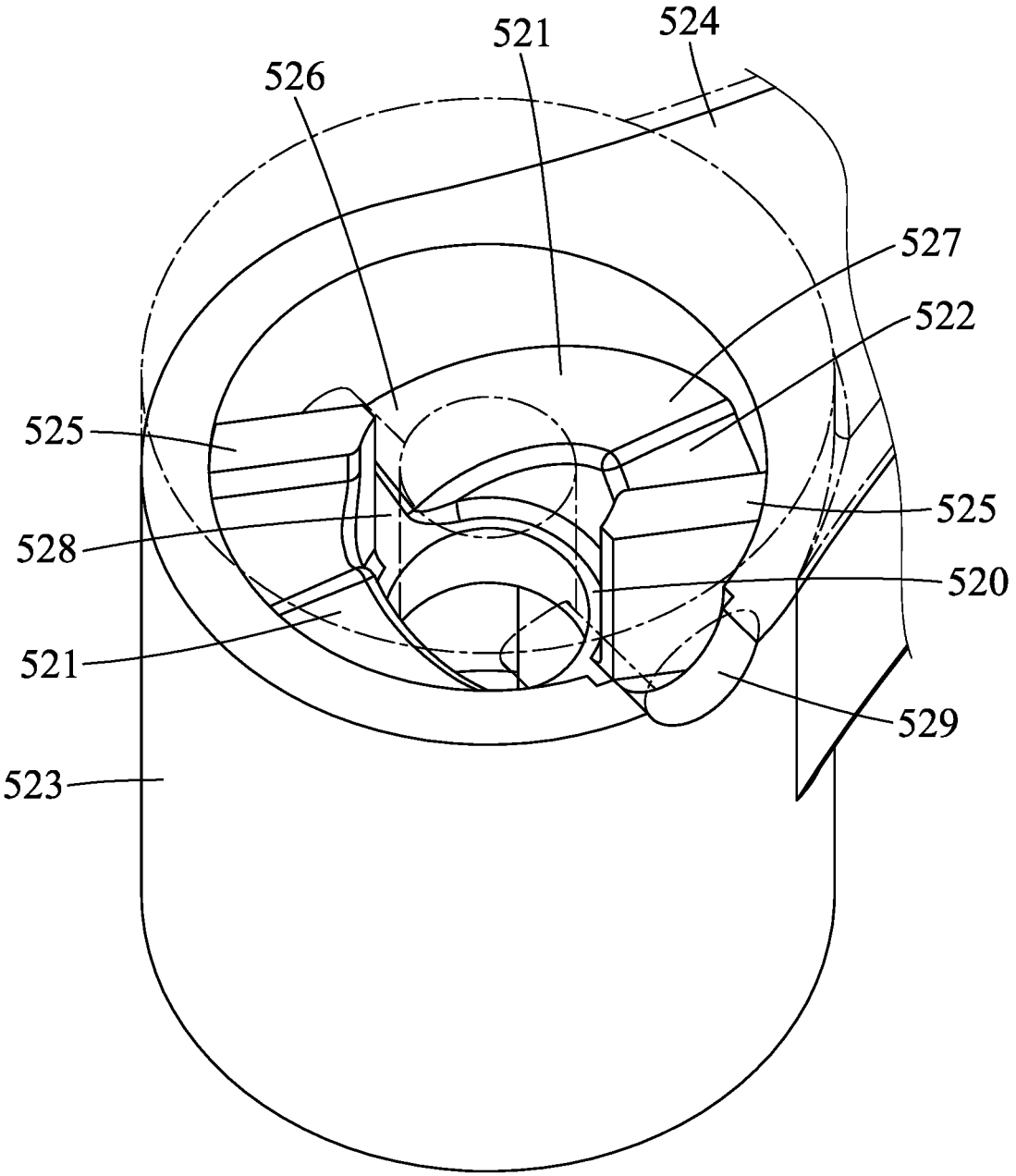
FIG. 9 is a fragmentary, enlarged perspective view of a tuning member of the embodiment.

With reference to FIGS. 7, 8 and 9, each turning member 52 has a base wall 520 which extends normal to the axis (L) and is spaced apart from the worktable 22 along the axis (L) to face the driven crosspiece 53, two slope surface segments 521 which project from the base wall 520 toward the driven crosspiece 53 and are disposed diametrically opposite to each other and each of which extends and is inclined angularly to have a proximal end 526 and a distal end 527, two engaging slots 522 which are adjoined with the distal ends 527 of the slope surface segments 521, respectively, and two stop walls 525 which project from the base wall 520 and are adjoined with the engaging slots 522, respectively. Each of the stop walls 525 is disposed at a side of a respective one of the engaging slots 522 opposite to the distal end 527. Each turning member 52 further has a surrounding wall 523 which surrounds the base wall 520 and extends along the axis (L), and a grip portion 524 which extends radially and outwardly from an outer surface of the surrounding wall 523. The surrounding wall 523 surrounds the axis (L) to define an accommodation chamber 528 therein for accommodating the slope surface segments 521 and having an opening opposite to the worktable 22. The surrounding wall 523 has an access hole 529 extending therethrough to communicate with the accommodation chamber 528. The end cap 54 is disposed to removably cover the opening of the accommodation chamber 528. The surrounding wall 523 is coaxially sleeved around the tubular wall 413 of the corresponding slide seat 411.

Figure 10:
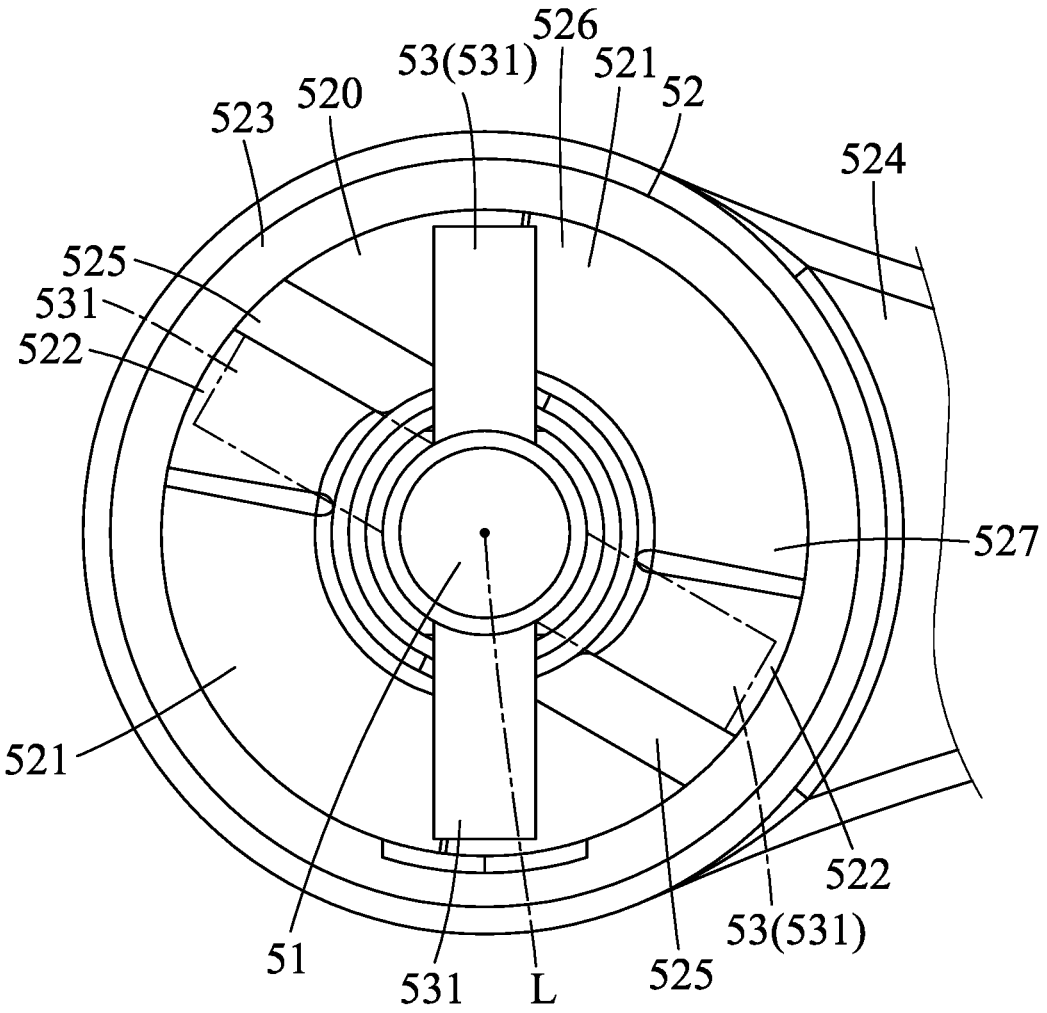
FIG. 10 is a fragmentary front view of a locking device of the embodiment.

Referring to FIGS. 7, 8 and 10, turning of the turning member 52 results in movement of the locking pin 51 relative to the worktable 22 between an engaging position (see FIG. 7) and a disengaging position (see FIG. 8). In the engaging position, the ends 531 of the driven crosspiece 53 abut against the proximal ends 526 to bring the retained end portion 511 of the locking pin 51 into engagement in the corresponding elongated slot 243 of the rail unit 24 to lock the moving unit 41 to the rail unit 24. During turning of the turning member 52, the ends 531 of the driven crosspiece 53 abut against and are slided along the slope surface segments 521 to be engaged in the engaging slots 522 (see the dash-dotted lines in FIG. 10) to bring the locking pin 51 in the disengaging position, where the retained end portion 511 of the locking pin 51 is disengaged from the elongated slot 243 to permit displacement of the moving unit 41 relative to the worktable device 2. The biasing member 55 is disposed to bias the locking pin 51 to the engaging position. The flat abutting surfaces 513 of the retained end portion 511 of the locking pin 51 are in abutting engagement with the elongated slot 243 when the locking pin 51 is in the engaging position so as to be retained to the corresponding slide rail 241 in the upright direction.

In assembly, the turning member 52 is sleeved around the tubular wall 413 of the corresponding slide seat 411. Then the locking pin 51 extends through the reinforcement plate 412, the biasing member 55 and the slide seat 411, and is inserted into the turning member 52. The driven crosspiece 53 is inserted into the accommodation chamber 528 through the access hole 529 and is mounted on the locking pin 51 through the penetrating bore 514. Finally, the end cap 54 is mounted on the turning member 52.

In use, a workpiece 9 is placed on the upper surface 221, and the reinforcement plates 412 are positioned on the selected retaining members 242 in accordance with the dimension of the workpiece 9. The slide seats 411 are brought to abut against the slide rails 241 to permit the locking pins 51 to be moved to the engaging position such that the rip fence device 4 is locked firmly to the worktable device 2 and the rip fence device 4 is movable with the sliding rails 241. When the rip fence device 4 is moved and positioned in a predetermined position on the worktable 22, the workpiece 9 is pushed against the abutted surface 421 of the rip fence 42 to slide on the upper surface 221 to be cut by the blade 31. When it is desired to detach the rip fence device 4, the turning members 52 are turned to move the locking pins 51 to the disengaging position such that the rip fence device 4 is displaceable relative to the worktable device 2. The reinforcement plates 412 are then removed from the retaining members 242 so as to permit removal of the rip fence device 4 from the worktable device 2.

With the turning member 52 which is turnable about the axis (L) and an extending direction of the axis (L) parallel to the upper surface 221 of the worktable 22, the operation of the turning member 52 is quick and convenient to conduct. With the locking pins 51 which are operable to move along the axis (L) to permit movement of the rip fence device 4 with the rail unit 24, the structure of the locking device 5 is simple to be easily fabricated and assembled. Further, the driven crosspiece 53 is inserted into the accommodation chamber 528 through the access hole 529 to be connected with the locking pin 51, which results in convenience during the maintenance and assembling of the locking device 5. Moreover, with the biasing member 55 and the slope surface segments 521, the locking pin 51 can be kept and positioned firmly in either one of the engaging and disengaging positions. Furthermore, the ends 531 of the driven crosspiece 53 can be stopped by the stop walls 525 to steadily keep the driven crosspiece 53 engaged in the engaging slots 522.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A table saw adapted for cutting a workpiece which has an abutting side, comprising:

a worktable device including a worktable and a rail unit disposed on said worktable and extending in a left-right direction, said worktable having an upper surface for placing the workpiece, said upper surface having an opening therethrough;

a saw blade device mounted on said worktable device and including a blade extending through said opening of said upper surface;

a rip fence device including a moving unit removably disposed on said rail unit, and a rip fence attached to said moving unit and extending in a front-rear direction perpendicular to the left-right direction, said rip fence having an abutted surface for the abutting side of the workpiece to abut thereagainst; and at least one locking device disposed on said rip fence device to couple said moving unit to said rail unit, said at least one locking device including a locking pin which extends and is movable along an axis relative to said moving unit, and a turning member which is turnable relative to said moving unit about the axis such that turning of said turning member about the axis results in movement of said locking pin along the axis relative to said worktable between an engaging position, where said locking pin engages in said rail unit to lock said moving unit to said rail unit, and a disengaging position, where said locking pin is disengaged from said rail unit to permit displacement of said moving unit relative to said worktable device, an extending direction of the axis being parallel to said upper surface, said at least one locking device further including a driven crosspiece connected with said locking pin and extending transverse to the axis to have two ends, said turning member having a base wall which is spaced apart from said worktable along the axis to face said driven crosspiece, two slope surface segments which project from said base wall toward said driven crosspiece and are disposed diametrically opposite to each other and each of which extends and is inclined angularly to have a proximal end and a distal end, and two engaging slots which are respectively adjoined with said distal ends of said slope surface segments, each of said ends of said driven crosspiece being in movable abutting engagement with a respective one of said slope surface segments such that, during turning of said turning member, said driven crosspiece abuts against said proximal ends to bring said locking pin in the engaging position, and slides along said slope surface segments to be engaged in said engaging slots to bring said locking pin in the disengaging position.

2. The table saw as claimed in claim 1, wherein said turning member further has two stop walls which project from said base wall and are adjoined with said engaging slots, respectively, each of said stop walls being disposed at a side of a respective one of said engaging slots opposite to said distal end such that each of said ends of said driven crosspiece is stoppable by a respective one of said stop walls to keep said driven crosspiece engaged in said engaging slots.

3. The table saw as claimed in claim 2, wherein said turning member further has a surrounding wall which surrounds said base wall and extends along the axis, and a grip portion which extends radially and outwardly from an outer surface of said surrounding wall.

4. The table saw as claimed in claim 3, wherein said surrounding wall surrounds the axis to define an accommodation chamber therein for accommodating said slope surface segments and having an opening opposite to said worktable, said surrounding wall having an access hole extending therethrough to communicate with said accommodation chamber, said at least one locking device further including an end cap which is disposed to removably cover said opening of said accommodation chamber.

5. The table saw as claimed in claim 3, wherein said moving unit has at least one slide seat attached to an end of said rip fence and having an L-shaped wall which is in abutting engagement with said rail unit, and a tubular wall which extends from said L-shaped wall in the front-rear direction and which is coaxially inserted into said accommodation chamber of said turning member.

6. The table saw as claimed in claim 5, wherein said worktable device further includes two guideways disposed on front and rear sides of said worktable, respectively, and each extending in the left-right direction, said rail unit having two slide rails which are slidably engaged with said guideways in the left-right direction, respectively, and a plurality of retaining members which are disposed on said slide rails, said moving unit having two of said slide seats which are disposed on said slide rails, respectively, and two reinforcement plates each disposed between said worktable and a respective one of said slide seats, each of said reinforcement plates having a notch for engagement with a selected one of said retaining members in an upright direction that is transverse to both the left-right direction and the front-rear direction.

7. The table saw as claimed in claim 6, wherein each of said slide rails has an elongated slot which extends in the left-right direction and penetrates in the front-rear direction, said locking pin having a retained end portion which is in abutting engagement with said elongated slot when said locking pin is in the engaging position so as to be retained to said corresponding slide rail in the upright direction.

8. The table saw as claimed in claim 7, wherein said locking pin has a driven end portion which is opposite to said retained end portion along the axis and which projects outwardly of said tubular wall, said driven end portion having a penetrating bore extending therethrough in the upright direction for said driven crosspiece to extend through said penetrating bore.

9. The table saw as claimed in claim 1, wherein said at least one locking device further includes a biasing member interposed between said locking pin and said moving unit to bias said locking pin to the engaging position.

* * * * *